US012012748B2

(12) United States Patent
Simpson et al.

(10) Patent No.: US 12,012,748 B2
(45) Date of Patent: Jun. 18, 2024

(54) PARTITION BRACKET ASSEMBLY

(71) Applicant: BRACELOK IP LIMITED, Auckland (NZ)

(72) Inventors: Scott Alexander Simpson, Auckland (NZ); Nigel Park, Auckland (NZ); Oliver Barnett, Hamilton (NZ)

(73) Assignee: BRACELOK IP LIMITED, Auckland (NZ)

( * ) Notice: Subject to any disclaimer, the term of this patent is extended or adjusted under 35 U.S.C. 154(b) by 204 days.

(21) Appl. No.: 17/611,023

(22) PCT Filed: May 6, 2020

(86) PCT No.: PCT/NZ2020/050042

§ 371 (c)(1),
(2) Date: Nov. 12, 2021

(87) PCT Pub. No.: WO2020/231273

PCT Pub. Date: Nov. 19, 2020

(65) Prior Publication Data

US 2022/0298777 A1 Sep. 22, 2022

(30) Foreign Application Priority Data

May 14, 2019 (NZ) ..... 753507
May 14, 2019 (NZ) ..... 753529

(51) Int. Cl.
*E04B 1/38* (2006.01)

(52) U.S. Cl.
CPC ..... *E04B 1/388* (2023.08); *E04B 2001/389* (2023.08)

(58) Field of Classification Search
CPC .... E04B 1/388; E04B 2001/389; E04B 2/825; E04B 9/183; E04B 9/20; E04B 2009/186; E04B 2/824; E04H 9/021
See application file for complete search history.

(56) References Cited

U.S. PATENT DOCUMENTS 3,402,517 A * 9/1968 Halfaker ..... E04B 9/20 52/126.5
3,889,937 A 6/1975 Statler
(Continued)

FOREIGN PATENT DOCUMENTS

JP S61254760 A 11/1986
JP 6283863 3/2019
(Continued)

OTHER PUBLICATIONS

3M Industrial Products Accessories for Abrasive Products 2017 catalog in p. 2, and 3M disc holder adapter description online page, (https://www.3m.com/3M/en_US/p/d/b40068099/) (Year: 2017).*
(Continued)

*Primary Examiner* — Terrell L McKinnon
*Assistant Examiner* — Ding Y Tan
(74) *Attorney, Agent, or Firm* — Wells St. John P.S.

(57) ABSTRACT

A bracket assembly for connecting the head track (282) of a partition wall (280) to an overhead structural component (298) of the building has a shaft (102) connected at right angles to a base plate (106), which in turn is connectable to the head track (282) so that the shaft extends substantially vertically upwards. A pair of upwardly extending wings (118) and an apertured intermediate portion (116) allowing the bracket to be slidingly disposed about the shaft. The wings (118) are connectable to arm portions (288), which in turn are connectable to linking flanges (292), connectable to the overhead structure 298. Springs (130, 132) bias the bracket towards a neutral position. The bracket (110) is retained on the shaft by an upper stop (108) and the base plate 106. Apertured stabilising means (122,124) disposed about the bracket (110) form a collar that guides and stabilises the bracket (110) as it slides relative to the shaft (102) during seismic activities.

13 Claims, 16 Drawing Sheets

(56) References Cited

U.S. PATENT DOCUMENTS

| | | | | |
|---|---|---|---|---|
| 5,228,254 | A | 7/1993 | Honeycutt, Jr. | |
| 5,237,786 | A | 8/1993 | Kochansky | |
| 6,122,871 | A | 9/2000 | Russell et al. | |
| 9,732,517 | B1 | 8/2017 | Huang | |
| 9,869,085 | B2 | 6/2018 | Evans et al. | |
| 10,865,559 | B2 * | 12/2020 | Newbrough | E04B 1/41 |
| 11,674,304 | B2 * | 6/2023 | Landreth | E04B 1/2403 52/272 |
| 2008/0250731 | A1 | 10/2008 | Wheeler | |
| 2016/0251845 | A1 * | 9/2016 | Evans | E04B 1/388 52/698 |
| 2019/0285224 | A1 * | 9/2019 | McKechnie | F16M 11/18 |
| 2022/0090372 | A1 * | 3/2022 | Landreth | E04H 9/021 |

FOREIGN PATENT DOCUMENTS

| | | | | |
|---|---|---|---|---|
| WO | WO 2015/053639 | | 4/2015 | |
| WO | WO-2015053639 | A1 * | 4/2015 | E04B 1/40 |
| WO | WO 2015/107509 | | 7/2015 | |
| WO | WO 2018/051253 | | 3/2018 | |
| WO | WO 2020/053745 | | 3/2020 | |
| WO | WO-2020053745 | A1 * | 3/2020 | E04B 1/2403 |
| WO | PCT/NZ2020/050042 | | 8/2020 | |

OTHER PUBLICATIONS

Vertibrace video on vimeo from T&R interior systems, dated Feb. 2019, https://vimeo.com/316692869 (Year: 2019).*

Online article titled "Dealing with Vertical Actions: Partitions" in Apr. 2019 EBossnow issue, weblink: https://www.eboss.co.nz/ebossnow/t-and-r-interior-systems-vertibrace-partition-wall-restraint (Year: 2019).*

Tracklok(TM) Seismic Bracing Guide Partitions & Ceilings, third edition, Sep. 2018 (Year: 2018).*

USG Seismic Technical Guide 2012 (Year: 2012).*

T & R Interior Systems, "Dealing with Vertical Actions: Partitions", 2019, 7 pages.

DIY Chatroom, "Shaky Partition Wall", https://www.diychatroom.com/threads/shaky-partition-wall.176021, published Apr. 1, 2013, 5 pages.

Email chain regarding Vertibrace sample and installation guide sent to Tracklok, Apr. 12, 2019, New Zealand, 2 pages.

T & R Interior Systems, "Check out the concept driving our new Vertibrace Bracket! A partition restraint system that allows for vertical movement caused by interstorey deflection", www.Facebook.com, United States, Feb. 20, 2019, 1 page.

T & R Interior Systems, "Proud of the T & R Stand at the NZIA", www.Facebook.com, United States, Feb. 18, 2019, 1 page.

T & R Interior Systems, "Vertibrace Installation Guide", Wayback Machine archive, published Jan. 31, 2020, New Zealand, 6 pages.

T & R Interior Systems, "We're proud to be the first partition restraint system in New Zealand (and possibly the world) to offer an allowance for vertical displacement" www.Facebook.com, United States, Feb. 25, 2019, 3 pages.

Tracklok Specification Sheet & Installation Guide, Apr. 2016, New Zealand, 4 pages.

Tracklok, "Build Efficiency and Cost Reduction", https://www.tracklok.com/news/2018/10/2/build-efficiency-and-cost-reduction, published Sep. 18, 2018, 3 pages.

* cited by examiner

PARTITION BRACKET ASSEMBLY

FIELD OF THE INVENTION

The present invention relates to an improved bracket assembly. The bracket assembly of the present invention has particular application to connecting a partition wall and/or related components (such as a ceiling grid) to an overhead structural component of a building. However, the invention may also have other applications.

BACKGROUND

In offices, partition walls are not structural. They are generally of lightweight construction utilising GIB-BOARD® or other plasterboard cladding. In some cases, partition walls utilise glazing. They can collapse or otherwise fail during earthquakes or other situations where the building is subjected to high forces and moments, placing the occupants at risk. The problem is how to connect partition walls to the structure of the building to allow for relative vertical movement between the partition walls and the overhead structure (such as the floor above, or the roof), whilst still resisting relative sideways forces. The same applies to suspended ceiling grids, which are also not structural.

Devices for attaching a non-structural component(s) of a building, such as a partition wall(s) and/or ceiling grid(s), to an overhead structural component(s) of the building, are known.

One such device is the bracket assembly disclosed in NZ631234, which comprises a generally V-shaped bracket mounted on a bearing member and a sleeve member. The sleeve member attaches to the non-structural components, while the arms of the bracket are connected via elongate linking members to the overhead structure. It is effective in resisting lateral forces.

The bracket assembly of NZ631234 provides an effective and user-friendly means for sturdily anchoring the non-structural components, helping to proof these against selected seismic and wind loadings. However, it is not specifically designed to accommodate vertical movement as between the non-structural components and the overhead structure (referred to as "vertical deflection"). In builds where it is necessary to account for vertical deflection, the bracket assembly of NZ631234 must be used in conjunction with extraneous components such as a deflection track. This adds to complexity of design and installation, and therefore also to cost.

Another prior art solution is the Vertibrace® product the subject of WO2020053745—A BRACKET—equivalent to New Zealand Patent Application No. 755216—with which the present application is in conflict. The Vertibrace® product has a fixed sleeve attached to a head track of a partition wall and a shaft free to move up or down within the sleeve. The two components are not connected together and the shaft can pull free from the sleeve so that a plastic cable tie passing through cross apertures in the shaft and the sleeve is used to keep the two together during installation. The upper end of the shaft (in use) is connected to a pair of wings extending at 45 degrees from the top of the shaft and these can be connected to the overhead structure by extension pieces and two 45-degree anchor plates. Once installed the plastic cable tie needs to be cut and removed to allow the shaft to move up or down within the sleeve. Since the shaft and sleeve are not locked together (apart from the cable tie), there is a risk that, if not installed correctly, or even if correctly installed, the device will fail as significant vertical movement will result in the two components coming apart. Even when the two parts are still in contact, the vertical movement of the shaft upwardly in its sleeve will not be able to resist significant lateral forces.

WO2020053745 has an international filing date of 10 Sep. 2019 and claims 4 different priority dates. The first two of which disclose only the sheath fixed to the top of the partition wall with the shaft free to move with respect to the fixed sheath. It was not until the priority application dated 30 May 2019 that the alternative combination of a shaft fixed to the top of the partition wall and a sliding collar was disclosed. The present application is entitled to a priority date of 14 May 2019 for all of its claims and hence a whole of contents objection applies against WO2020053745. Claim 1 has be inserted to emphasize the whole of contents objection against WO2020053745.

Telescopic sliding connections are known from the following documents:

WO2018051253A1
WO2015107509A1
U.S. Pat. No. 5,228,254A
U.S. Pat. No. 5,237,786A
US2005016112A1
U.S. Pat. No. 4,103,463A
U.S. Pat. No. 4,037,380A
U.S. Pat. No. 6,158,179A
GB1392310.

Another prior art solution is the TRACKLOK® FLAT product, which braces adjacent (i.e. perpendicular) partition walls off one another to adequately anchor the walls while allowing vertical deflection. However, this solution employs a different method of operation and as such there remains a need to provide a bracket assembly that specifically accommodates vertical deflection.

Accordingly, it is an object of the present invention to provide a bracket assembly for sturdily and securely connecting non-structural components of a building to the overhead structure while also allowing a measure of vertical deflection. At the very least, it is an object of the present invention to provide the public with a useful choice.

STATEMENTS OF THE INVENTION

According to one aspect of the invention, there is provided an adjustable partition wall bracket comprising:

a first attachment system for attaching the bracket to an upper surface of a partition wall;

a second attachment system for attaching the bracket to an upper structure;

a shaft; and a sleeve comprising a hollow region for slidably receiving a portion of the shaft therein;

wherein the shaft or the sleeve is slidable relative to the other to adjust the bracket so as to generally absorb vertical compression and expansion actions/forces.

Preferably, the shaft and sleeve are slidable relative to each other to automatically adjust the bracket to accommodate vertical displacements between the wall and the upper structure.

Preferably whichever of the shaft or the sleeve is connected to the first attachment system they are connected in such a way that when in use, they are oriented substantially vertically with respect to the upper surface of the partition wall.

Preferably the shaft is connected to the first attachment system so that it can be fixedly attached to an upper surface of the partition wall, and the sleeve is connected to the second attachment system.

Preferably the bracket assembly comprises at least one vertical biasing means disposed about the shaft, above or below (or both) the sleeve and configured to, in use, urge the bracket into a neutral position.

Preferably the shaft has a stop at each end and the sleeve is slidable on the shaft between the stops.

Preferably the second attachment system has a profile formed substantially as a truncated V-shape, comprising a central portion and a pair of angled wing portions configured to, in use, be connected to the overhead structure via linking components.

Preferably, the shaft is longer than the sleeve.

Preferably, the sleeve configured as or with a collar and the hollow region is provided by an aperture in the collar to allow the shaft to pass therethrough.

According to another aspect of the invention, there is provided a bracket assembly for connecting a non-structural component of a building to an overhead structural component of the building, the bracket assembly comprising:

a lower shaft member configured to, in use, be connectable to the non-structural component;

an upper shaft member configured to, in use, be engaged with and movable substantially vertically relative to the lower shaft member; and a bracket configured to, in use, be connectable to the overhead structural component, wherein the bracket is configured to, in use, be connectable to the upper shaft member and movable substantially vertically therewith.

Preferably, the non-structural component comprises a partition wall.

Preferably, the partition wall comprises a head track disposed at its upper end, to which the lower shaft member is connectable in use.

Preferably, the overhead structural component ("overhead structure") comprises a roof structure of the building, or a floor structure of a storey of the building directly above a space where the non-structural component is located.

Preferably, the lower shaft member is configured to, in use, be connectable to the non-structural component proximate a lower end of the lower shaft member.

Preferably, one of the shaft members is configured as a sleeve having an interior passageway capable of receiving the other shaft member to allow telescopic sliding movement therebetween.

Preferably, the lower shaft member is configured as the sleeve.

Alternatively, the upper shaft member is configured as the sleeve.

Preferably, the bracket assembly is configured with a neutral position, being the position, in use, of the components of the bracket assembly relative to one another in the absence of applied forces acting on the bracket assembly.

Preferably, the bracket assembly is configured to accommodate vertical movement of between substantially 20 mm to 30 mm in either direction from the neutral position.

More preferably, the bracket assembly is configured to accommodate vertical movement of about 25 mm in either direction from the neutral position.

Preferably, the bracket assembly comprises at least one vertical biasing means configured and dimensioned to, in use, retain the components of the bracket assembly in the neutral position in the absence of applied vertical forces and to oppose applied vertical forces acting on the bracket assembly in at least one direction.

Preferably, the at least one vertical biasing means is associated with the upper and/or lower shaft member. More preferably, the at least one vertical biasing means is disposed about the upper and/or lower shaft member.

Preferably, the at least one vertical biasing means is a spring.

Preferably, the bracket assembly comprises at least one horizontal biasing means configured and dimensioned to, in use, oppose applied forces acting on the bracket assembly in at least one substantially horizontal direction.

Preferably, the bracket has a profile formed substantially as a truncated V-shape, comprising a central portion and a pair of angled wing portions.

Preferably, the wing portions are configured to, in use, be connected to the overhead structure via linking components.

Preferably, the linking components comprise arm portions and connecting flanges, wherein the arm portions are configured to connect at a first end to the wing portions and at a second end to the connecting flanges and the connecting flanges are configured to connect to the overhead structure.

Preferably, the bracket is configured to, in use, be connectable to the upper shaft member at or proximate an upper/distal end of the upper shaft member, being the end of the upper shaft member which, in use, is distal from the lower shaft member.

Preferably, the bracket assembly comprises one or more stabilising members configured to, in use, be disposed above and/or below the central portion of the bracket to assist in preventing the bracket from tilting in use.

Preferably, the stabilising member(s) have a height and are provided with a central passageway complementary to the upper shaft member, such that, in use, the stabilising member(s) help to maintain the bracket at a level attitude.

Preferably, where the upper shaft member is configured as the sleeve, the sleeve is configured as or with a collar, and the interior passageway is provided by an aperture through the collar to allow the lower shaft member to pass therethrough and the collar to move relative the lower shaft member or vice versa.

Preferably, the at least one vertical biasing means is disposed about the upper and/or lower shaft member above and/or below the collar.

According to another aspect of the invention, there is provided a bracket assembly for connecting a non-structural component of a building to an overhead structural component of the building, the bracket assembly comprising:

a shaft configured to, in use, be connectable at substantially 90 degrees relative to the generally horizontal top surface of the non-structural component; and a bracket configured to, in use, be disposed about the shaft and to be connectable to the overhead structural component wherein the bracket is configured to, in use, be in a sliding relationship relative to the shaft, wherein the bracket assembly further comprises a first biasing means configured to, in use, be disposed about the shaft above or below the bracket and to urge the bracket into a neutral position along the shaft, being the position of the bracket in the absence of applied forces acting on the bracket.

Preferably, the non-structural component comprises a partition wall.

Preferably, the partition wall comprises a head track disposed at its upper end, to which the shaft is connectable in use.

Preferably, the overhead structural component ("overhead structure") comprises a roof structure of the building, or a floor structure of a storey of the building directly above a space where the non-structural component is located.

Preferably, the shaft comprises an elongate component.

Preferably, a length of the shaft is between substantially 95 mm and 135 mm.

More preferably, the length of the shaft is substantially 115 mm.

Preferably, the shaft has a substantially circular cross-section.

Preferably, the shaft is configured to, in use, be connectable to the non-structural component at a lower end of the shaft.

Preferably, the bracket assembly comprises an intermediate component(s) configured to, in use, facilitate connection between the lower end of the shaft and the non-structural component.

Preferably, the shaft comprises a connecting portion at its lower end configured to engage with the non-structural component and/or the intermediate component(s).

Preferably, the connecting portion comprises a threaded portion at the lower end of the shaft.

Alternatively, or in addition, the connecting portion comprises a region at the lower end of the shaft configured to engage with a fastening component(s) of the bracket assembly, such as a nut(s) and bolt(s), or a screw(s).

Preferably, an upper end of the shaft is provided with a stop configured to, in use, prevent the bracket from sliding upwardly beyond the shaft and hence disengaging therefrom.

Preferably, the bracket has a profile formed substantially as a truncated V-shape, comprising a central portion and a pair of angled wing portions configured to, in use, be connected to the overhead structure via linking components.

Preferably, the linking components comprise arm portions and connecting flanges, wherein the arm portions are configured to connect at a first end to the wing portions and at a second end to the connecting flanges and the connecting flanges are configured to connect to the overhead structure.

Preferably, the central portion of the bracket comprises an aperture configured to, in use, accommodate the shaft to enable the bracket to be in a sliding relationship relative to the shaft, wherein the aperture is substantially complementary to the cross-section of the shaft.

Preferably, the aperture is configured to provide, alone or in combination with one or more additional components, a collar surrounding the shaft and defining a passageway to accommodate the shaft in use.

Preferably, the bracket is configured to, in use, be rotatable about the shaft.

Preferably, the bracket assembly comprises one or more stabilising members configured to promote the sliding relationship of the bracket relative to the shaft and limit tilting or slanting of the bracket relative to the shaft.

Preferably, the stabilising member(s) comprise an upper and/or lower stabilising member connected to the bracket above and below the bracket (respectively), the stabilising member(s) configured with an aperture substantially complementary to the cross-section of the shaft, wherein the stabilising member(s) have a height such that the stabilising member(s), in combination with the central portion of the bracket, form the collar, with the aperture therethrough defining a passageway such that, in use, the stabilising member(s) serve as a guide(s) to stabilise or steady the sliding movement of the bracket relative to the shaft.

Preferably, the bracket assembly comprises an upper stabilising member disposed above the bracket and a lower stabilising member disposed below the bracket.

Preferably, the upper stabilising member comprises a nut having an inner thread and the lower stabilising member has a body portion and a neck portion, the neck portion having an external thread complementary to the inner thread of the nut, wherein the neck portion is configured to, in use, pass through the aperture on the central portion of the bracket to threadingly engage with the nut such that the upper and lower stabilising member are connected together with the central portion of the bracket clamped between them.

Preferably, the neutral position of the bracket is between the upper and lower end of the shaft.

Preferably, the neutral position of the bracket is between substantially 30 mm and 80 mm from the upper surface of the non-structural component; and more preferably, substantially 55 mm from the upper surface of the non-structural component.

Preferably, the first biasing means is configured and dimensioned such that, in use, it retains the bracket in the neutral position in the absence of applied forces on the bracket assembly and, when the bracket is displaced along the shaft, urges the bracket back towards the neutral position.

Preferably, the first biasing means is configured to be relaxed (that is, not under tension or compression) when the bracket is in the neutral position; and configured to be loaded (that is, placed under tension or compression) when the bracket is displaced along the shaft, such that as the first biasing means returns to its relaxed state it urges the bracket back towards the neutral position.

Preferably, the first biasing means is provided by at least one spring, such as a compression spring formed from wire coil.

Preferably, a wire diameter of the at least one spring is between substantially 0.90 mm and 1.12 mm; a spring rate of the at least one spring between substantially 0.100N/mm and 0.200N/mm; and a number of active coils of the at least one spring is between 6 and 14.

More preferably, a wire diameter of the at least one spring is substantially 1.00 mm; a spring rate of the at least one spring substantially 0.186N/mm; and a number of active coils of the at least one spring is 10.

Alternatively, the first biasing means is provided by at least one buffer formed from resilient material.

Preferably, the first biasing means is connected to the bracket, and to a portion of the bracket assembly proximate an end of the shaft.

Preferably, the bracket assembly comprises a second biasing means, disposed about the other portion of the shaft than the first biasing means; that is, above or below the bracket.

Preferably, the second biasing means is configured substantially similarly to the first biasing means.

Preferably, the bracket assembly is configured to accommodate vertical displacement of the bracket along the shaft of up to substantially 30 mm to 50 mm in either direction from the neutral position.

Preferably, the bracket assembly is configured to accommodate vertical displacement of the bracket along the shaft of up to substantially 40 mm in either direction from the neutral position.

According to another aspect of the invention, there is provided a method of assembling a bracket assembly for connecting a non-structural component of a building to an overhead structural component of the building, the bracket assembly comprising:

a shaft configured to, in use, be connectable to the non-structural component; and a bracket configured to, in use, be disposed about the shaft and to be connectable to the overhead structural component wherein the bracket is configured to, in use, be in a sliding relationship relative to the shaft, wherein the bracket assembly further comprises a first biasing means configured to, in use, be disposed about the shaft above or below the bracket and to urge the bracket into a neutral position along the shaft, being the position of the bracket in the absence of applied forces acting on the bracket, the method comprising the step of:

disposing the bracket and the first biasing means about the shaft.

According to another aspect of the invention, there is provided a method of installing a bracket assembly for connecting a non-structural component of a building to an overhead structural component of the building, the bracket assembly comprising:

a shaft configured to, in use, be connectable to the non-structural component; and a bracket configured to, in use, be disposed about the shaft and to be connectable to the overhead structural component wherein the bracket is configured to, in use, be in a sliding relationship relative to the shaft, wherein the bracket assembly further comprises a first biasing means configured to, in use, be disposed about the shaft above or below the bracket and to urge the bracket into a neutral position along the shaft, being the position of the bracket in the absence of applied forces acting on the bracket, the method comprising the steps of:

connecting the shaft to the non-structural component; and connecting the bracket to the overhead structural component.

Preferably, connecting the bracket to the overhead structural component comprises using linking components, comprising arm portions and connecting flanges, to connect the bracket to the overhead structural component, wherein the arm portions are connected at a first end to the bracket, at a second end to the connecting flanges, and the connecting flanges are connected to the overhead structural component.

According to another aspect of the invention, there is provided a kit of parts for a bracket assembly for connecting a non-structural component of a building to an overhead structural component of the building, the kit of parts comprising:

a shaft configured to, in use, be connectable at substantially 90 degrees relative to the generally horizontal top surface of the non-structural component;

a bracket configured to, in use, be disposed about the shaft and to be connectable to the overhead structural component, wherein the bracket is configured to, in use, be in a sliding relationship relative to the shaft; and a first biasing means configured to, in use, be disposed about the shaft above or below the bracket and to urge the bracket into a neutral position along the shaft, being the position of the bracket in the absence of applied forces acting on the bracket.

The present invention provides a number of optional advantages, including at least:

Providing a bracket assembly that allows connection between a non-structural component and an overhead structural component in a manner that is sturdy and robust while at the same time accommodating a measure of vertical deflection;

At the same time, providing a bracket assembly that effectively limits or moderates lateral movement of the non-structural component relative to the overhead structural component;

Providing a bracket assembly that is simple and convenient to install, and in particular that does not require the bracket to be held or temporarily fastened in the neutral position during installation, and also that allows the bracket to be rotated about the shaft during installation to position the bracket as required;

Providing a bracket assembly that is relatively cost-effective and convenient to manufacture; and At the very least, providing the public with a useful choice.

DESCRIPTION

Further aspects and advantages of the present invention will become apparent from the following description which is given by way of example only and with reference to the accompanying drawings, which are schematics for illustrative purposes only and in which.

Figure 5A:
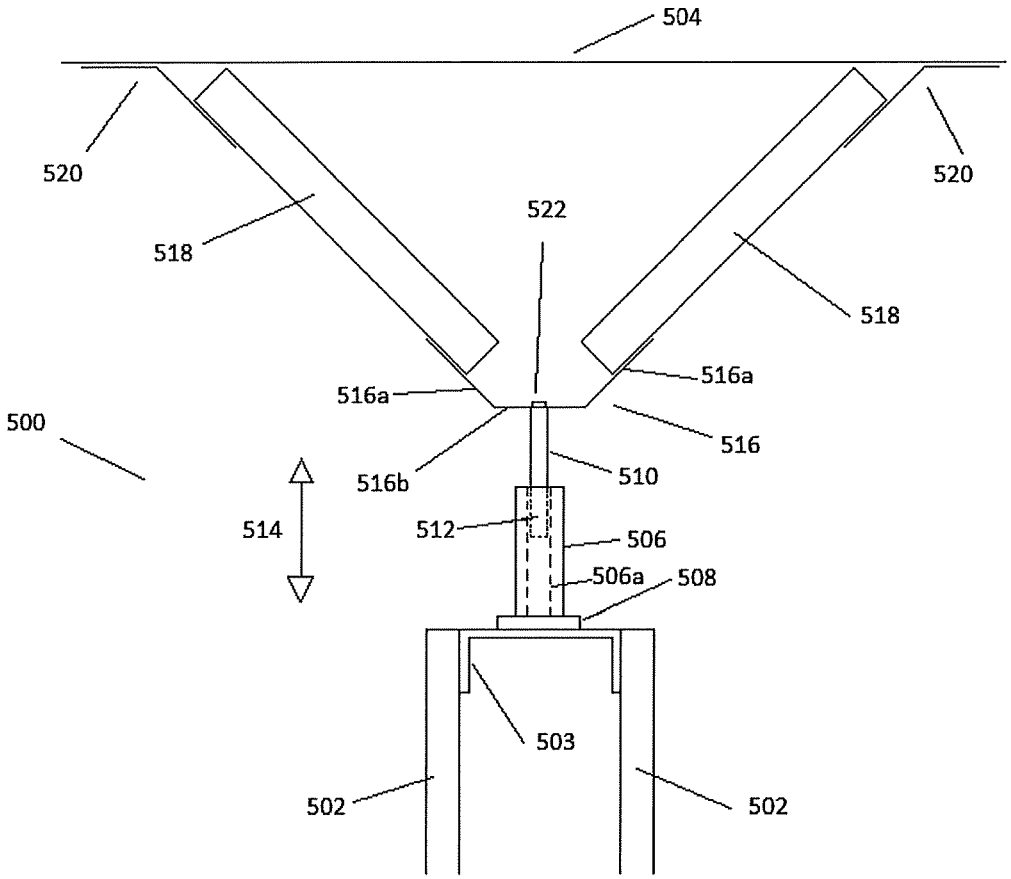
FIG. 5A is a side view of a bracket assembly according to another preferred exemplary embodiment of the invention, showing the bracket in the neutral position.
Figure 5A:
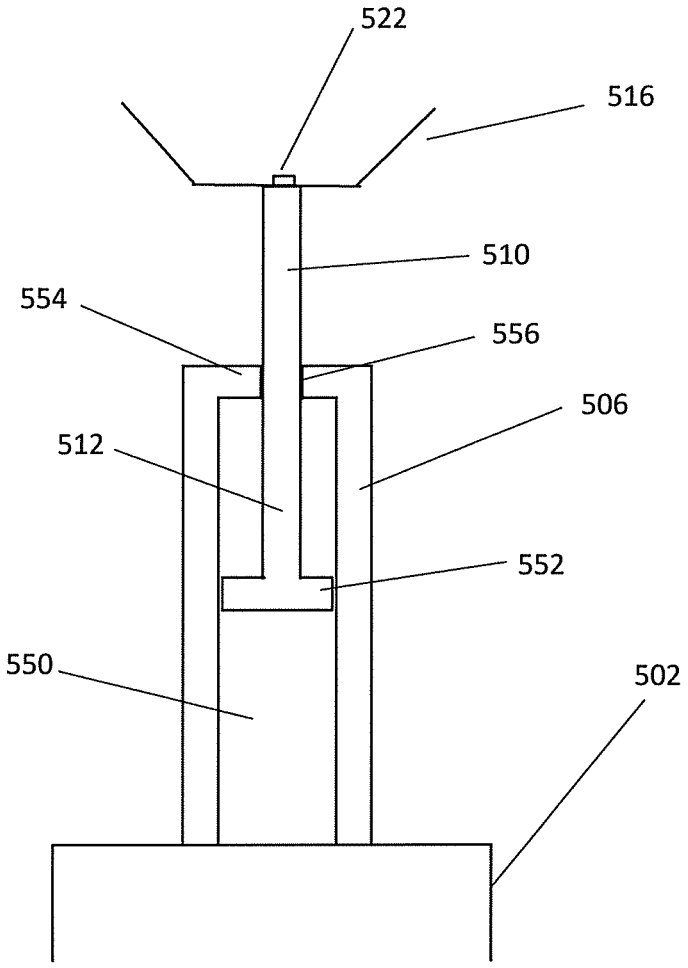
Figure 5A:
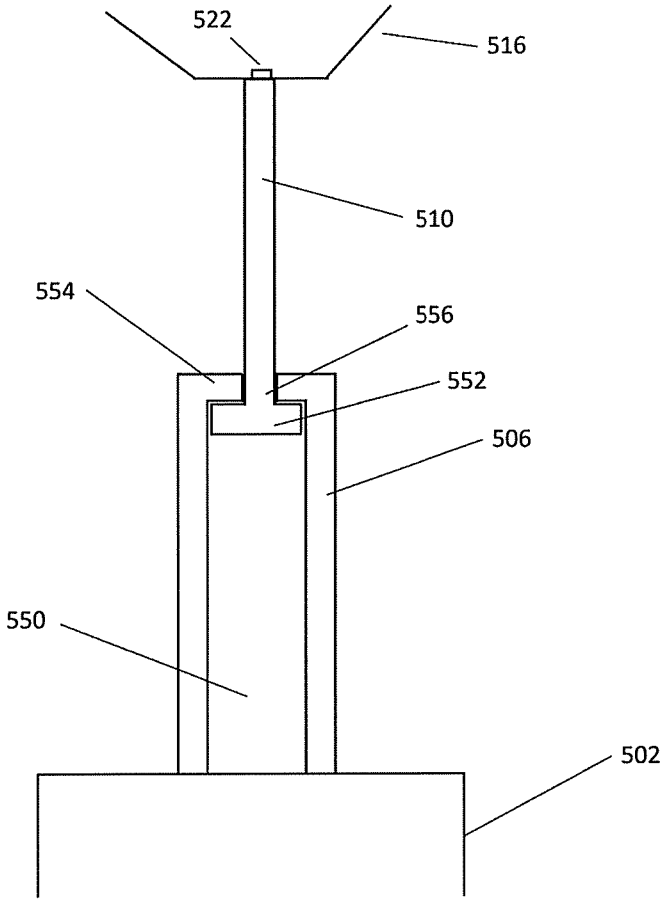
Figure 5A:
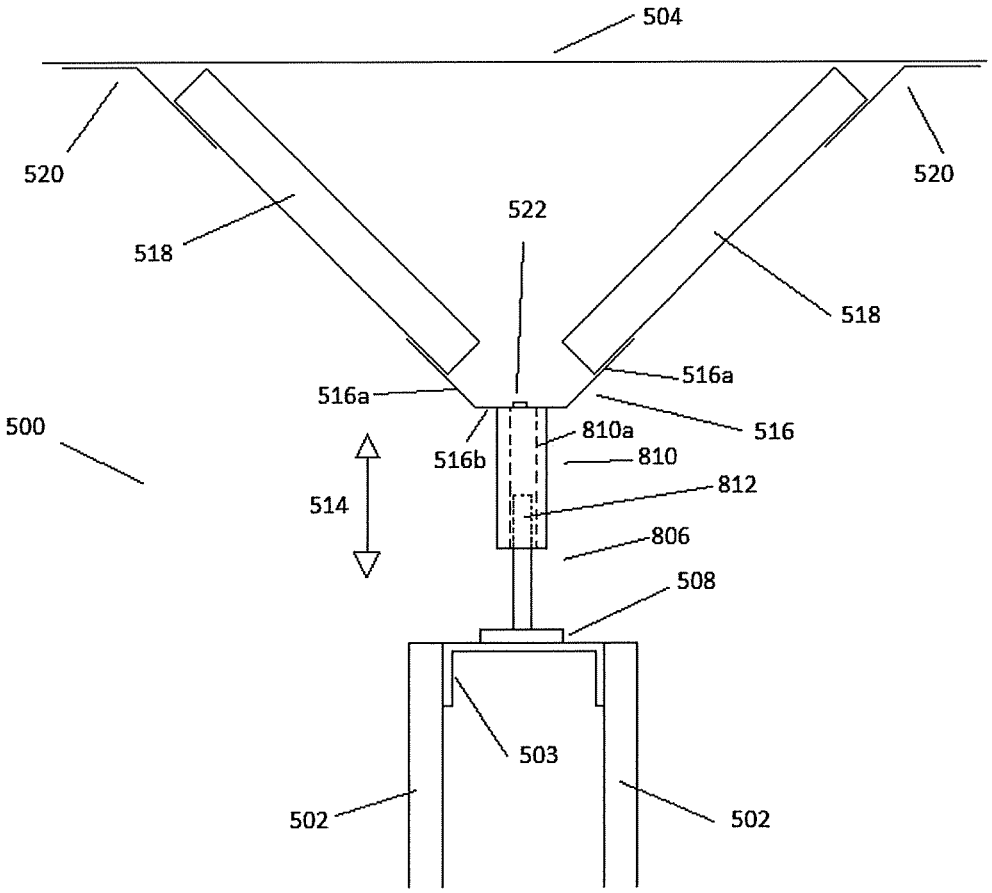
Figure 5B:
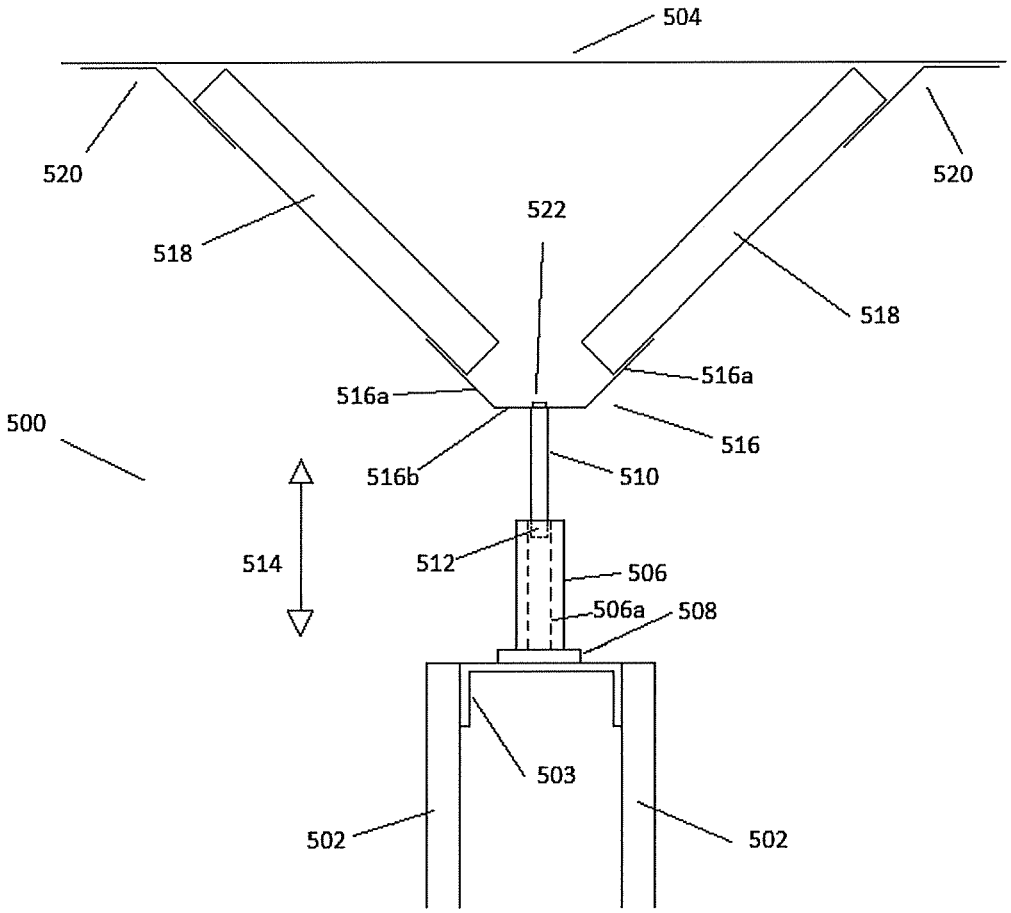
Figure 5C:
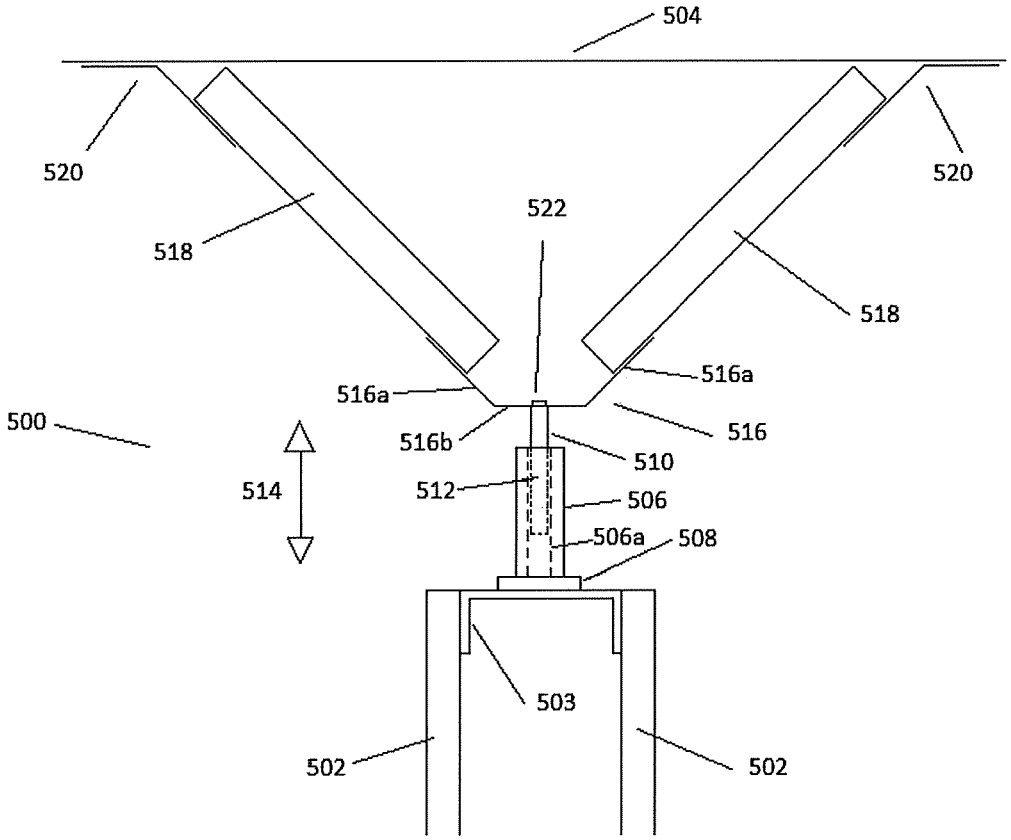
Figure 6:
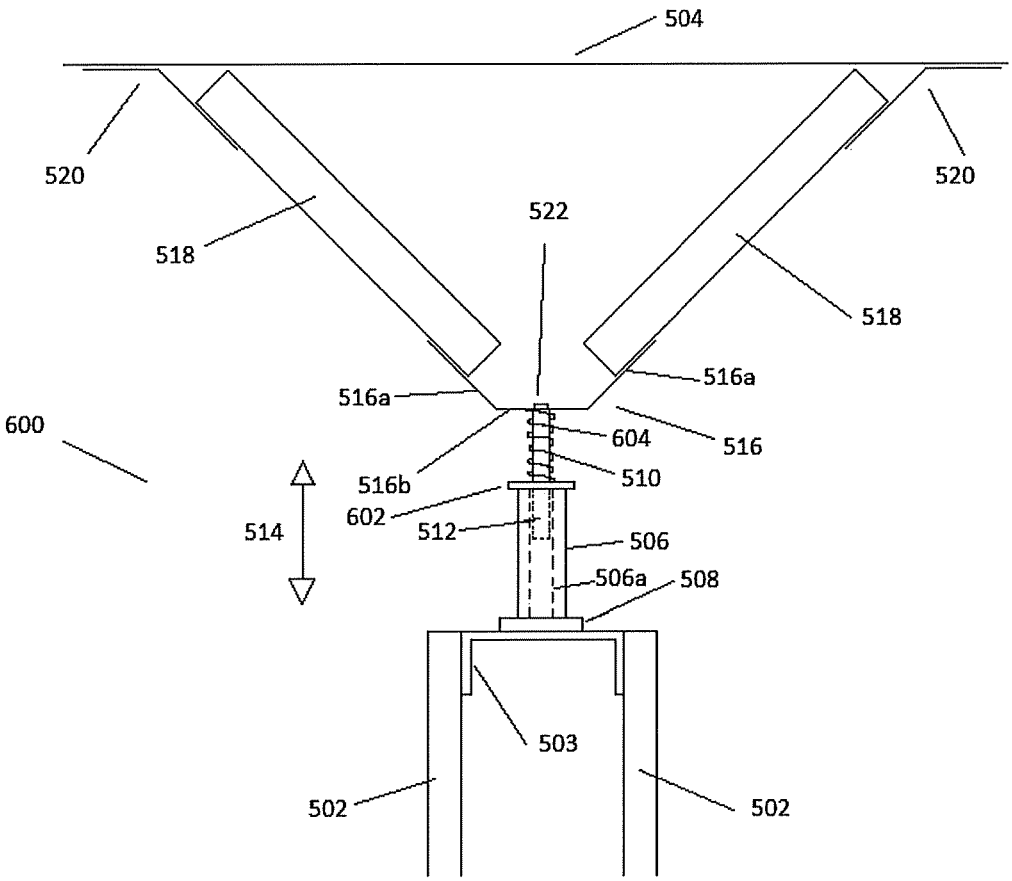

FIGS. 5AA and 5AB are cross-sectional views showing a variation on the bracket assembly of FIG. 5A according to another preferred exemplary embodiment of the invention;

FIG. 5AC is a side view showing another variation on the bracket assembly of FIG. 5A according to another preferred exemplary embodiment of the invention;

FIG. 5B is a side view of the bracket assembly of FIG. 5A, showing the bracket displaced upwardly from the neutral position;

FIG. 5C is a side view of the bracket assembly of FIG. 5A, showing the bracket displaced downwardly from the neutral position;

FIG. 6 is a side view of another preferred exemplary embodiment of the invention; and FIGS. 7A-7D are views of another preferred exemplary embodiment of the invention.

The following description will describe the invention in relation to examples and/or drawings. The invention is in no way limited to the example(s) and/or drawings as they are purely to exemplify the invention only and variations and modifications may be readily apparent to the skilled person without departing from the scope of the invention.

Figure 1:
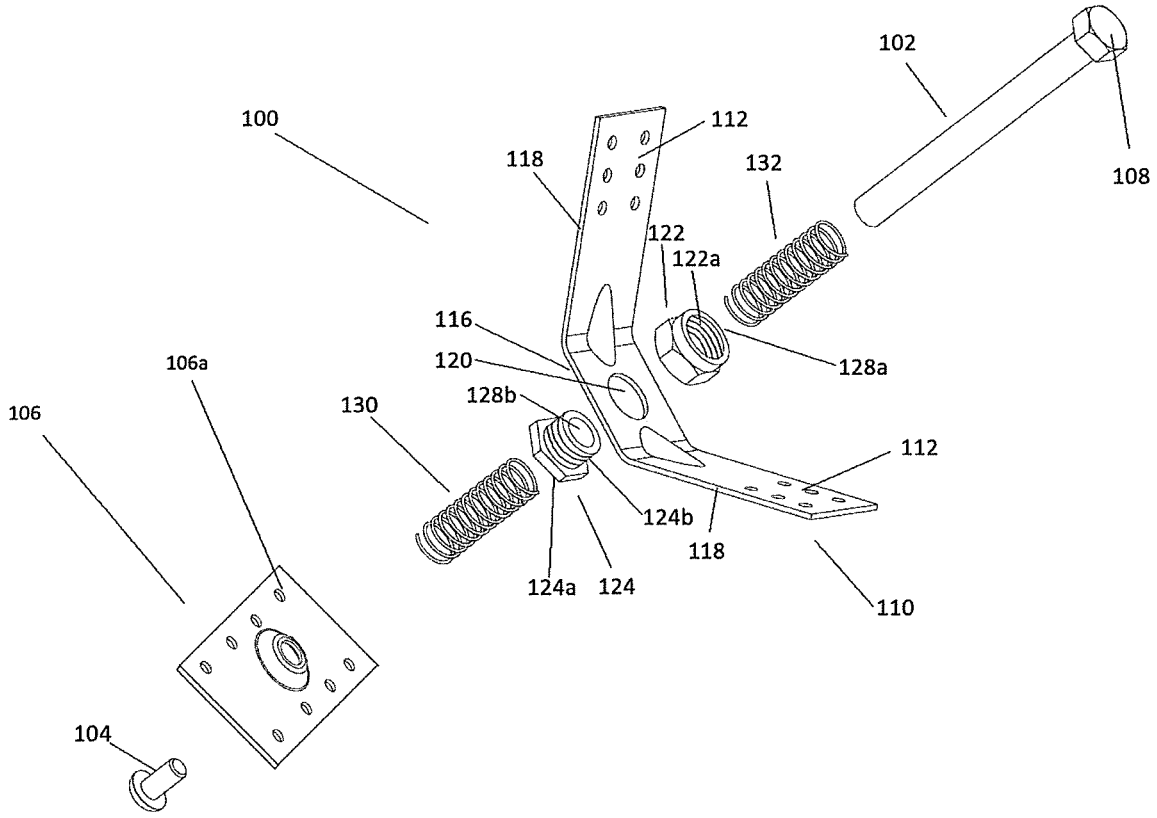
FIG. 1 is an exploded view of a bracket assembly according to one preferred exemplary embodiment of the present invention.
Figure 2:
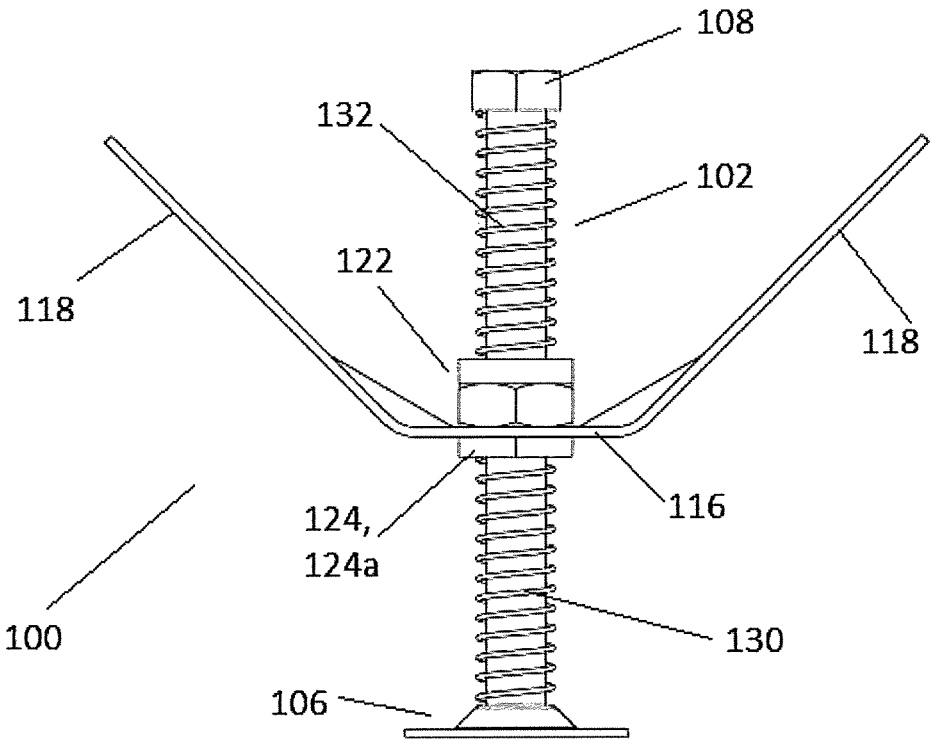
FIG. 2 is a side view of the bracket assembly of FIG. 1 when assembled.
Figure 2A:
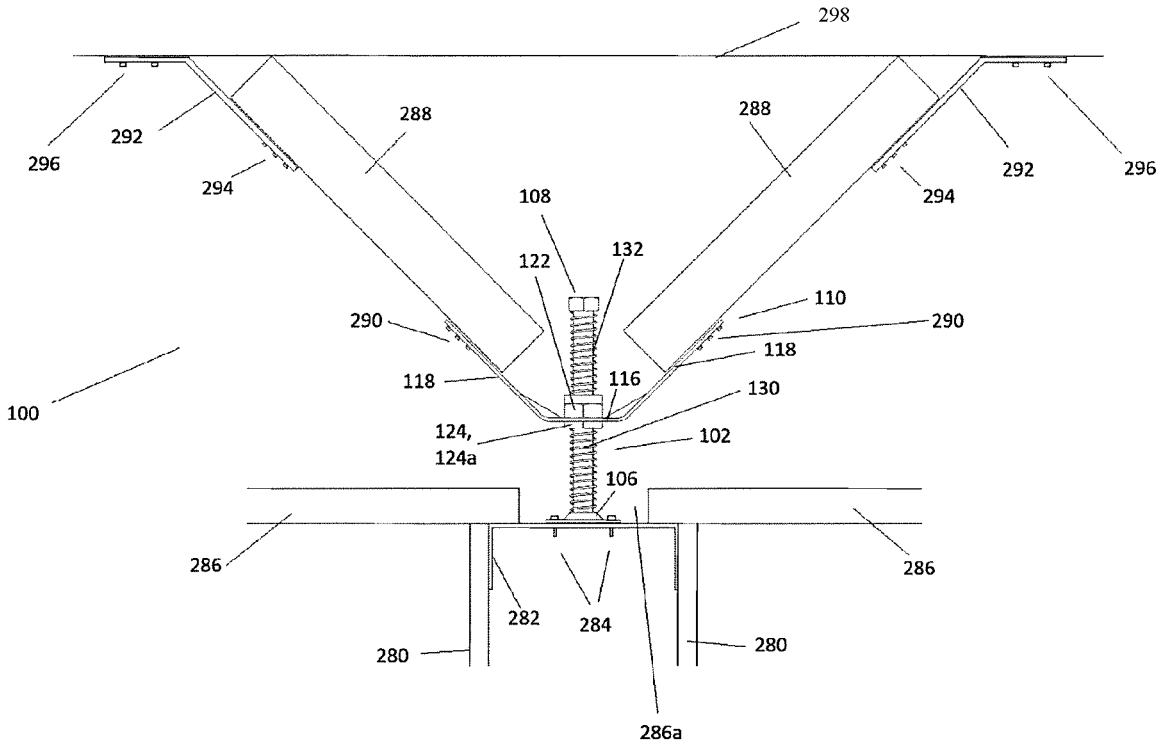
FIG. 2A is a side view of the bracket of FIG. 2 when installed.

FIGS. 1 and 2 show one exemplary preferred embodiment of the bracket assembly (generally indicated by 100); with FIG. 2A showing the bracket assembly (100) installed, i.e. connected to components of a building as discussed below.

The bracket assembly of this embodiment configured to connect a partition wall (280 in FIG. 2A) to a roof structure (298 in FIG. 2A). It will however be appreciated that the bracket assembly (100) may equally be used to connect other types of non-structural component, such as a ceiling grid, to other types of overhead structural component, such as a floor structure of a storey of the building directly above a space where the non-structural component is located.

The bracket assembly (100) of this embodiment comprises a shaft (102); a bracket (110); an upper (122) and lower (124) stabilising member; and a first (130) and second (132) biasing means.

The shaft (102) of this embodiment has a length of substantially 115 mm, although the skilled person will of course appreciate that other lengths may be suitable.

The shaft (102) is configured to engage at its lower end with a plinth/base plate (106), with a fastener (104) passing through both components to connect them. The plinth/base plate (106) in turn connects to a head track (282 in FIG. 2A) at a top end of the partition wall (280 in FIG. 2A), via fastening means such as screws (284 in FIG. 2A) which are passed through apertures (106*a*) on the plinth/base plate (106).

In this embodiment the plinth/base plate (106) is rectangular; specifically, 43 mm by 80 mm, wherein in use the plinth/base plate (106) is arranged such that its longer sides are substantially parallel with an elongate dimension of the headtrack.

However, variations on this are possible. The plinth/base plate may have different dimensions, or a different profile, such as a circular profile. Also, although the plinth/base plate (106) of FIGS. 1 and 2 is shown with a raised central portion, this is exemplary only and it is equally possible for the base plate (106) to be flat. The skilled person will readily envisage appropriate configurations for the base plate (106).

Alternatively the connection between the shaft (102) and the partition wall (280) may be of a different kind altogether (for instance those discussed below with reference to FIG. 5A); provided that said connection must be robust, to ensure the bracket assembly has adequate resistance to bending moments resulting from lateral forces in use. The head track (282) may be of any conventional kind known in the art; but preferably is of a kind that is fixed relative to the partition wall (280) as this may promote resistance of the bracket assembly (100) to bending moments resulting from lateral forces in use.

As shown in FIG. 2A, as part of installing the bracket it will typically be necessary to ensure that the "false ceiling" (286), namely ceiling tiles or similar that abut the top of the partition wall (280), is provided with an appropriate gap (286*a*) so as to allow the lower end of the shaft (102) to be connected to the head track (282) atop the partition wall (280). This can be achieved via conventional means as will be readily envisaged by the skilled person.

Returning now to FIG. 2, at its upper end the shaft (102) includes a stop/flange (108) to prevent the other components from sliding too far upwards and disengaging from the shaft (102). This is advantageous in use as well as during installation. It will be understood that the plinth/base plate (106) at the lower end of the shaft (102), or otherwise the connection between the shaft (102) and the head track (282), effectively provides a stop at the lower end of the shaft (102).

The bracket (110) has a truncated V-shaped profile including a central portion (116) and a pair of angled wing portions (118), which extend at substantially a 45° angle relative to the central portion (116). It will however be appreciated that the bracket may have other configurations, such as a tapered truncated V-shape, or even a continuous or substantially continuous arced profile. The arms of the bracket may also be configured unevenly (i.e. extending at different angles relative to the central portion). This may for instance be desired if the bracket is configured for installation proximate a wall or to fit around utilities in the ceiling cavity. In such a case, one arm may extend at, for instance, substantially 45° from the central portion, while the other extends substantially vertically.

The central portion (116) of the bracket (110) comprises an aperture (120). The aperture (120) is substantially complementary to a cross-section of the shaft (102), although for the reasons discussed below, in this embodiment is somewhat larger than the cross-section of the shaft (specifically to accommodate the neck portion (124*b*) of the lower stabilising member (124)).

In use, the shaft (102) is disposed in the aperture (120), allowing the bracket (110) to slide up and down relative to the shaft (102). The bracket (110) is also able to rotate about the shaft (102), allowing the bracket (110) to be easily positioned as required during installation.

The bracket (110)/aperture (120) thus provide, alone or in combination with one or more stabilising members (discussed below), a collar/sleeve surrounding the shaft (102) and defining a passageway to slidably accommodate the shaft (102) in use.

The wing portions (118) of the bracket (110) are configured to, in use, engage arm portions (288 in FIG. 2A) of linking components. To this end, the wing portions (118) are provided with a series of fixing apertures (112) through which appropriate fastening means, such as screws (290 in FIG. 2A) pass to connect the wing portions (118) to the arm portions (288).

The arm portions in turn connect to the overhead structure (298) via linking flanges (292 in FIG. 2A). The linking flanges (292) are secured to, respectively, the arm portions (288) and the overhead structure (298) via appropriate fastening means such as screws ((294) and (296), respectively, in FIG. 2A). This connection configuration promotes lateral stability of the bracket in a similar manner as described in NZ631234.

The bracket assembly (100) of this embodiment comprises an upper stabilising member (122) and a lower stabilising member (124), the stabilising members (122, 124) configured to provide a collar/sleeve in combination with the central portion (116) of the bracket (110). The collar/sleeve is dimensioned to be substantially complementary to the cross-section of the shaft (102), so as to be a snug fit about the shaft (102) while still permitting slidability.

The upper stabilising member (122) is configured as a nut having an internal thread (122*a*). The lower stabilising member (124) has a cross-section formed substantially as an inverted T-shape, comprising a body portion (124*a*) and a relatively narrow neck portion (124*b*) having an external thread corresponding to that of the nut (122, 122*a*). The neck portion (124*b*) is somewhat smaller than the aperture (120) on the central portion (116) of the bracket (110). Both the upper and lower stabilising member (122, 124) comprise a passageway (128*a*, 128*b*) passing therethrough, the passageway (128*a*, 128*b*) being substantially complementary to the cross-section of the shaft (102).

In use, the neck portion (124*b*) is passed through the aperture (120) on the bracket (110) and threadingly engages with the nut (122), thereby clamping the central portion (116) of the bracket (110) between the nut (122) and the body portion (124*a*) of the lower stabilising member (124), as shown in FIG. 2. The passageways (128*a*, 128*b*) on the stabilising members (122, 124), along with the aperture (120) on the central portion (116) of the bracket, together form a collar/sleeve that acts as a "guide" for movement of the bracket (110) up and down the shaft (102), and in particular helps prevent the bracket (110) from slanting or tilting. This also promotes lateral stability of the bracket assembly.

It will however be appreciated that a range of other configurations of the stabilising member(s) are possible. For example, the stabilising member(s) may be manufactured integrally with the central portion of the bracket in the form of an integral collar/sleeve, rather than being provided by separate components. There may also be just an upper or lower stabilising member, rather than both.

In still another example, the bracket assembly may be configured without stabilising members at all. For instance, the central portion of the bracket may be relatively thick, such that it alone provides a collar/sleeve having a passageway (defined by its central aperture) that assists in guiding and stabilising the bracket.

The bracket assembly (100) of this embodiment comprises both a first (130) and second (132) biasing means, disposed about the shaft (102) below and above the bracket (110), respectively. It will however be appreciated that, as exampled below, the bracket assembly may be configured with just a single biasing means.

In this embodiment, both biasing means (130, 132) are provided by compression springs; more particularly by compression springs having the following properties: a wire diameter of substantially 1.00 mm; a spring rate of substantially 0.186N/mm; and a number of active coils of 10.

However, the biasing means may alternatively be provided by a compression spring having different parameters, a different kind of spring, or a different material(s) and/or component(s) altogether, such as a resilient rubber material.

The first compression spring (130) maintains the bracket (110) in a neutral position in the absence of applied forces, as shown in FIG. 2.

In this embodiment, in the neutral position the central portion (116) of the bracket (110) sits substantially 55 mm from the top of the partition wall (not shown). It will of course be appreciated that this distance, and/or the dimensions/proportions of the bracket assembly (100) more generally, may be varied to suit the technical requirements of a given situation.

Generally speaking, it is desirable for the neutral position of the bracket (110) to be relatively low above the partition wall. This firstly makes the bracket assembly (100) better able to withstand bending moments resulting from lateral (sideways) forces. Secondly, in use the bracket (110) is typically expected to be displaced upwardly relative to the shaft (102) by a greater distance it is than downwardly. For instance, wind forces acting on the overhead structure (in the case of a roof) are expected to primarily cause upward displacement. Accordingly, it is preferable to allow more capacity for upward displacement of the bracket (110) than downward displacement; which entails setting the neutral position of the bracket (110) relatively low along the shaft; such as in the FIG. 2 embodiment substantially 55 mm from the top of the partition wall (with the overall length of the shaft being substantially 115 mm as noted above).

Turning to consider the action of the springs (130, 132); in the case of downward vertical deflection, that is, when the bracket (110) moves downwardly, the first compression spring (130) will compress to absorb this movement and then urge the bracket (110) back towards the neutral position; and the second compression spring (132) will do the same in the case of upward vertical deflection. In this embodiment, the bracket assembly (100) is configured to tolerate vertical deflection of the bracket (100) by substantially 40 mm in either direction from the neutral position. However, it will be appreciated that this distance may be varied and the skilled person will readily envisage means of achieving this.

At the same time, the robust connection of the shaft (102) to the partition wall (280), along with the connection of the bracket assembly to the overhead structure (298), means the bracket assembly has resistance to bending moments resulting from lateral forces.

By virtue of the bracket assembly (100) having a first and second compression spring (130, 132), configured, respectively, to absorb upward and downward vertical deflection of the bracket (110), the first and second compression spring (130, 132) need not be connected to the bracket (110) or the shaft (102) since neither spring (130, 132) needs to exert a tensile force on the bracket (110) (although they may be so connected if desired).

Figure 3:
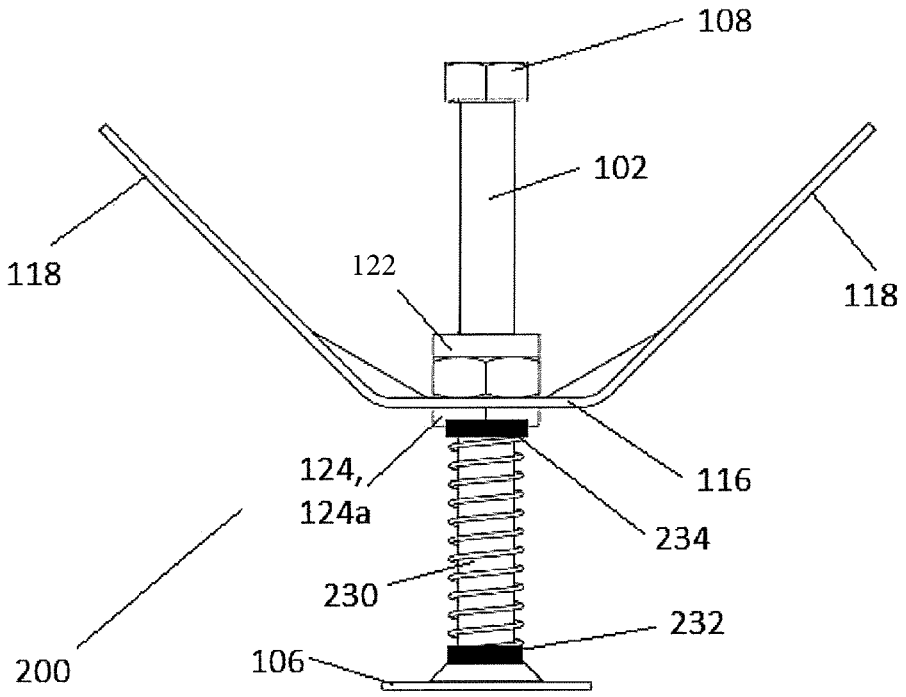
FIG. 3 is a side view of a bracket assembly according to another preferred exemplary embodiment of the invention.
Figure 4:
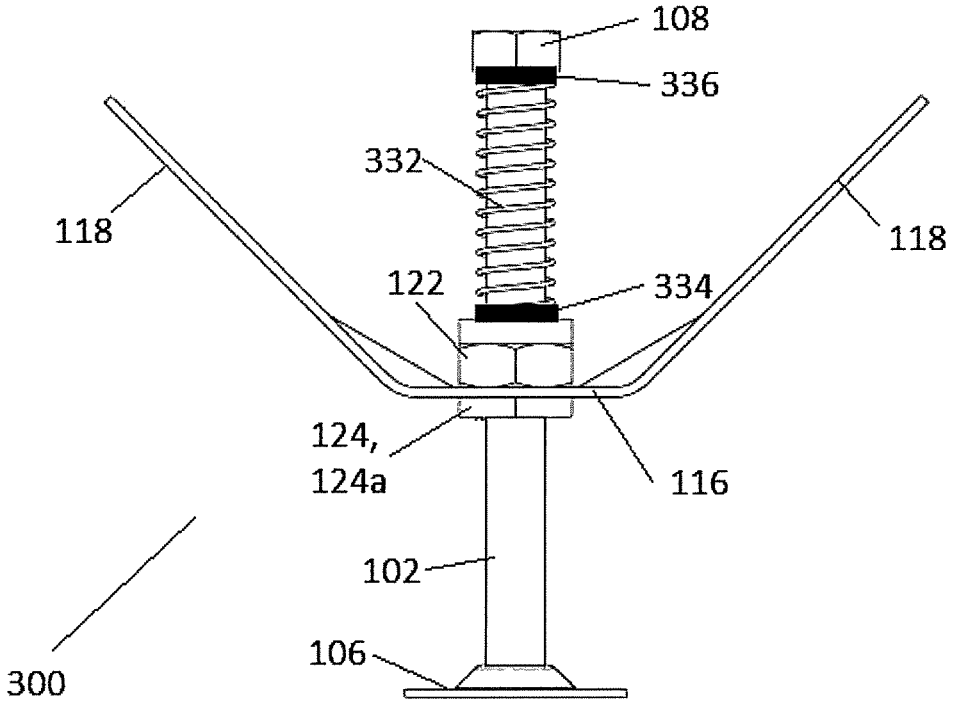
FIG. 4 is a side view of a bracket assembly according to another preferred exemplary embodiment of the invention.

FIGS. 3 and 4 show alternative exemplary embodiments each having only one spring (230, 332, respectively), wherein in both cases the spring (230, 332) is connected to the bracket (110), and to a region proximate an end of the shaft (102). Connection of the spring (230, 332) may be accomplished by any conventional means, such as welding, adhesion, ties or bolting.

In the embodiment of FIG. 3, the bracket assembly (generally indicated by 200) only comprises a spring (230) below the bracket (110). The spring (230) is connected to the bracket (110), more particularly to the lower stabilising member (124), as schematically indicated by (234). The spring (230) is also connected proximate the lower end of the shaft (102) as schematically indicated by (232). The spring (230) being connected in this manner enables it to account for both upward and downward deflection of the bracket (110); in the latter case by compression, as discussed above in relation to FIGS. 1 and 2, and in the former case by exerting a tensile force on the bracket (110).

However, it will be appreciated that the embodiment of FIG. 3 would also be functional without connection of the spring (230) to the bracket (110) or shaft (102) in this manner, albeit with upward deflection of the bracket (110) not being absorbed and hence potentially a less effective system.

In the embodiment of FIG. 4, the bracket assembly (generally indicated by 300) only comprises a spring (332) above the bracket (110). The spring (332) is connected to the bracket (110), more particularly to the upper stabilising member (122), as schematically indicated by (334). The spring (332) is also connected proximate an upper end of the shaft (102) as schematically indicated by (336). The spring (332) being connected in this manner enables it, firstly, to keep the bracket (110) suspended in the neutral position absent applied loading; and, secondly, to account for both upward and downward deflection of the bracket (110) by compression and tension, respectively.

It will be understood that the components of the bracket assembly of FIGS. 1-4 are formed from suitable materials. It is particularly preferred for at least the shaft and/or the bracket to be formed from stainless steel. However, the skilled person may envisage other appropriate materials for the shaft, the bracket, and/or the other components of the bracket assembly.

FIGS. 5A-5C, 6, and 7A-7D relate to embodiments of the invention that are aimed at addressing the same problem, but differ from those of FIGS. 1-4 in the following respect. Rather than using a fixed shaft and slidable bracket, the embodiments of FIGS. 5A-5C, 6, and 7A-7D employ a telescoping configuration wherein the lower shaft provides a sleeve within which the upper shaft slides. The bracket is fixedly connected to the upper shaft, and hence slides up and down with it. Thus when vertical forces act on the bracket, it transmits these to the upper shaft, which accordingly slides upwardly or downwardly within the lower shaft (with the bracket sliding up and down with it).

The bracket assembly (500) of FIG. 5A is shown connecting a partition wall (502) to an overhead structural component (504), although the bracket assembly (500) can be used to connect other types of non-structural components besides partition walls, for example ceiling grids, to overhead structural components of buildings.

The bracket assembly (500), which is shown in its neutral position, comprises the following components: a lower shaft member (506); an upper shaft member (510); and a bracket (516).

The lower shaft member (506) is connected at its lower end to the partition wall (502), and more particularly a head track (503) mounted at the top of the partition wall. The head track may be of any conventional kind known in the art; but preferably is of a kind that is fixed relative to the partition wall (502) as this may promote resistance of the bracket assembly (500) to bending moments resulting from lateral forces in use. In this embodiment, connection between the lower shaft member (506) and the head track (503) is achieved via an intermediate component, namely a plinth/base plate (508), using conventional fastening means such as screws (not shown in FIG. 5A; (710) in FIG. 7D).

However, the skilled person will appreciate that many other connection configurations and/or means may be used to engage the lower shaft member (506) to the head track (503), so long as the resulting connection provides adequate resistance to bending moments resulting from lateral forces. For example, the lower end of the lower shaft member (506) may directly abut the head track (503) and be connected thereto via a range of fastening means, for instance a screw, bolt or rivet passing upwardly through the head track into the lower shaft member. In another example, the lower shaft member (506) may be configured to be vertically somewhat "offset" from the head track (503); for instance, an aperture in the head track (503) may allow the lower shaft member (506) to extend some distance into the "cavity" between the partition wall panels.

The lower shaft member (506) is configured with an interior passageway (506*a*) so as to form a sleeve within which the upper shaft member (510) slides vertically in use, that is, when applied vertical forces displace the bracket (516) from its neutral position as indicated by arrow (514). A portion of the upper shaft member (510) is accordingly disposed within the interior passageway (506*a*) of the lower shaft member (506), as indicated in dashed lines at (512).

It will be appreciated that the interior passageway (i.e. sleeve) (506*a*) of the lower shaft member (506) should be dimensioned to be substantially complementary to the cross-section of the upper shaft member (510). In this way, the passageway (506*a*) provides a snug fit about the upper shaft member ((510), specifically portion (512)), promoting stability and robustness of the bracket assembly while also allowing slidability as between the shaft members. This is best illustrated in FIG. 7C.

The interior passageway (506*a*) in the lower shaft member (506) may extend along an entire length of the lower shaft member; or partway along its length. It is even possible for the interior passageway (506*a*) to be open at the lower end of the lower shaft member, such that, in use, the upper shaft member (510) can slide downwardly past this point and into the cavity between the partition wall panels.

The skilled person will appreciate that the relative lengths of the upper and lower shaft members (506, 510), as well as the interior passageway (506*a*), should be selected so as to promote the lateral stability of the bracket assembly. In particular, if too small a portion (512) of the upper shaft member (510) remains in the interior passageway (506*a*) during maximal upward displacement, the small degree of overlap between the respective shaft members (506, 510) may reduce the lateral stability of the assembly, i.e. make it more prone to sideways movement or tilting.

Vertical movability of the upper shaft member (510) relative to the lower shaft member (506) could be achieved via alternative configurations. For example, it is possible for the upper shaft member (510) to provide the sleeve, with the lower shaft member (506) being slidable within the upper shaft member (510). This is schematically illustrated in FIG. 5AC, discussed immediately below. Conceivably, vertical movability might also be achieved by a configuration other than a telescoping arrangement, such as for instance a ratchet or articulated mechanism; or by a block having adjacent apertures in which the upper and lower shaft member respectively slide.

FIG. 5AC schematically illustrates the above-noted variation on the embodiment of Figure A, wherein the bracket assembly is in effect "turned upside down"—the upper shaft member (810) provides the sleeve, and the lower shaft member (806) is slidable within an interior passageway (810*a*) of the upper shaft member (810), such that a portion (812) of the lower shaft member (806) is disposed within the interior passageway (810*a*) of the upper shaft member (810).

The lower shaft member (810) is connected to the head track (503), as schematically indicated by (508). This connection may be effected via any suitable means, such as those discussed above. The bracket (516) is fixedly connected to the upper shaft member (806), as schematically indicated by (522). Again this connection may be effected via any suitable means, such as those discussed below.

As with the embodiment of FIG. 5A, vertical movement of the partition wall (502) and overhead structure (504) relative to each other (i.e. towards or away from each other) will cause the upper and lower shaft member (810, 806) to slide vertically relative to one another (514), absorbing vertical deflection. Thus a greater or lesser portion (812) of the lower shaft member (806) will be disposed within the interior passageway (810*a*) of the upper shaft member (810) depending on vertical deflection as between the partition wall (502) and the overhead structure (504).

Returning now to FIG. 5A, the bracket (516) has a V-shaped profile with a central portion (516*b*) and a pair of angled wing portions (516*a*). However, variations on this shape are possible and will be readily envisaged by the skilled person.

The bracket (516) is connected to the overhead structure (504) via linking components comprising arm portions (518) connected at one end to the wings (516*a*) and at the other end to connecting flanges (520), which in turn are connected to the overhead structure (504). All these connections may be of a conventional type, such as screws, nuts and bolts, nails, or welding; and are similar to those described above in relation to FIG. 2A; and also to those described in NZ631234.

The bracket (516) is fixedly connected to the upper end of the upper shaft member (510) via a conventional fastening means such as a screw (522). The upper end of the upper shaft member (510) may be appropriately configured to this end, such as with an internal thread. It will be clearly understood that the bracket (516) and upper shaft member (510) are therefore fixedly connected to one another, such that they move together up and down when vertical forces displace them from the neutral position.

FIGS. 5B and 5C schematically illustrate what happens when vertical forces acting on the bracket assembly (500) of FIG. 5A cause the bracket (516) to be displaced in, respectively, an upward and downward direction from the neutral position.

In FIG. 5B, vertical forces have caused the bracket (516) to move upwardly. Since the bracket (516) is fixedly connected to the upper shaft member (510), the bracket (516) takes the upper shaft member (510) with it, meaning the upper shaft member (510) slides upwardly within the lower shaft member (506). Accordingly, it can be seen that a larger portion of the upper shaft member (510) now protrudes above the lower shaft member (506); with a much smaller portion of the upper shaft member (510) than in FIG. 5A still disposed within the interior passageway (506*a*) of the lower shaft member (506), as indicated in dashed lines at (512).

It will be appreciated that the bracket assembly (500) may optionally be configured with a "stop" or "retaining means" to help prevent the upper shaft member (510) from "popping out" of the lower shaft member (506) if upward displacement of the former relative to the latter is too great. For instance, the lower end of the upper shaft member (510) may be configured with a flange or protrusion, with the interior passageway (506*a*) of the lower shaft member (506) being configured with a corresponding flange or protrusion; an example configuration of this kind is schematically shown in FIGS. 5AA and 5AB, discussed below. As also discussed there, however, ideally the bracket assembly is in any case configured and dimensioned such that, even at maximal upward displacement, a sufficiently long portion (512) of the upper shaft member (510) remains disposed within the lower shaft member (506) to promote lateral strength and stability of the bracket assembly.

FIG. 5C shows the converse situation to FIG. 5B, namely where vertical forces have caused the bracket (516) to move downwardly. Once again, since the bracket (516) is fixedly connected to the upper shaft member (510), it pushes the upper shaft member (510) downwardly within the lower shaft member (506), i.e. causes it to slide downwardly in the interior passageway (506*a*) of the lower shaft member (506). Thus it can be seen that a much larger portion (indicated in dashed lines at (512)) of the upper shaft member (510) is now within the interior passageway (506*a*) of the lower shaft member (506) than before.

It will be appreciated that, while the above description has referred specifically to the bracket (516) being displaced up or down, it is also possible for vertical forces in a given situation to displace a different component of the bracket assembly, instead of the bracket itself. Taking for instance a situation in which the distance between the partition wall (502) and overhead structure (504) decreases. Assuming, firstly, that this is due to the overhead structure (504) moving downwardly relative to the partition wall (502): in this case, the bracket (516) of FIG. 5A will indeed be pushed downwardly, and accordingly the upper shaft member (510) will also slide downwardly within the interior passageway (506*a*) of the lower shaft member (506). In the embodiment of FIG. 5AC, the bracket (516) will likewise be pushed downwardly and this will cause the upper shaft member (810), which in this case provides the sleeve, to slide downwardly over the lower shaft member (806). But now assuming the converse, namely that the partition wall (502) moves upwardly relative to the overhead structure (504) (although the skilled person will appreciate that in practice this is less likely to be the case). In this scenario, the bracket (516) itself will remain stationary. Rather, in the case of FIG. 5A, the lower shaft member (506) will be displaced upwardly, and thus will slide upwardly over the upper shaft member (510). Likewise, in FIG. 5AC, the lower shaft member (806) will be displaced upwardly, and thus will slide upwardly within the sleeve provided by the interior passageway (810*a*) of the upper shaft member (810). Thus it will be clearly understood the present invention is directed to a bracket assembly whose respective components are movable relative to one another to absorb vertical deflection.

FIGS. 5AA and 5AB are schematics (for illustrative purposes only) showing a cross-sectional view of a bracket assembly similar to that of FIGS. 5A, 5B and 5C, but with a number of further elements (for completeness, it is noted that the configuration of FIGS. 5AA and 5AB could also be employed in conjunction with the embodiments of FIGS. 6 and 7A-7D, discussed below). FIG. 5AA shows the bracket assembly with the bracket (516) in the neutral position, while FIG. 5AB shows the bracket assembly when vertical forces have caused the bracket (516) to become displaced upwardly.

As will now be explained, in the embodiment of FIGS. 5AA and 5AB, the interior passageway (506*a*) is somewhat wider than the upper shaft member (510) itself, to accommodate the protrusion (552) on the upper shaft member (510). Importantly, however, the lower shaft member (506) as a whole is configured so as to still provide a snug (but at the same time slidable) fit about the upper shaft member (510), promoting the robustness and integrity of the bracket assembly.

The upper shaft member (510) is configured with a protrusion (552) at its lower end. The protrusion (552) may continue around the entire circumference of the upper shaft member (510), or it may be in the form of, for instance, discrete flanges disposed at intervals about the circumference of the upper shaft member (510).

The lower shaft member (506) is configured with a complementary protrusion (554) at its upper end, facing inwardly and defining an opening (556) at its centre complementary to the cross-section of the upper shaft member (510), to allow the upper shaft member (510) to pass through. The protrusion (554) may likewise continue around the entire circumference of the lower shaft member (506), or may be in the form of, for instance, discrete flanges disposed at intervals about the circumference of the lower shaft member (506). It will be understood, however, that whatever the chosen configuration of the protrusions (552, 554), they must be configured to interact with each other in use. For instance, if one of the protrusions (552, 554) takes the form of discrete flanges, it is preferable that the other is continuous about the circumference. This way, interaction between the protrusions (552, 554) in use will be assured regardless of the axial orientation of the upper (510) and lower (506) shaft members relative to each other.

As schematically indicated in FIG. 5AA, when the bracket assembly is at or proximate the neutral position, the protrusion (552) slides up and down within the interior passageway (506*a*) along with the upper shaft member (510); that is to say, the bracket assembly behaves in the same way as described above with reference to FIGS. 5A-5C.

As schematically indicated in FIG. 5AB, when the bracket (516) and hence the upper shaft member (510) are displaced upwardly by a relatively large amount, the protrusion (552) on the upper shaft member (510) abuts the protrusion (554) on the lower shaft member (506), helping prevent the upper shaft member (510) from "popping out" of the interior passageway (506*a*) of the lower shaft member (506).

Of course, it will be appreciated that, if the forces acting on the bracket assembly are too great, the bracket assembly or other elements of the system may fail in spite of this. That is to say, the protrusions (552, 554) do not assure the integrity of the bracket assembly in all circumstances. Rather, they are a measure to help prevent the upper shaft member (510) from "popping out" in the course of normal use, including during assembly/installation of the bracket assembly. Furthermore, as noted above it is desirable for the upper and lower shaft members (510, 506) to be dimensioned such that there is always a certain amount of overlap (512) between them, as this tends to promote the lateral strength of the bracket assembly. As such, protrusions (552, 554) of this kind ideally should not be relied on to define the maximal extent of upper deflection of the bracket in use, as it is preferable that the upper shaft member (510) is never displaced this far upwardly. Rather, if present, the primary function of the protrusions (542, 554) should be to retain the components together during handling/assembly/installation.

FIG. 6 is a schematic showing a bracket assembly (generally indicated by 600) according to another preferred exemplary embodiment of the present invention. The bracket assembly (600) of FIG. 6 is substantially similar to that of FIGS. 5A-5C, but with several additional components.

The additional components comprise a vertical biasing means (604), in this embodiment provided by a spring (604), disposed about the upper shaft member (510); and a flange (602), in this embodiment provided by a circular disc, provided at an upper end of the lower shaft member (506) to support the spring (604).

The spring (604) is advantageous in that it retains the components of the bracket assembly (600) in the neutral position relative to one another in the absence of applied vertical forces. It also opposes vertical forces when applied to the bracket assembly (600), urging the components back towards the neutral position. In the depicted embodiment, downward movement of the bracket (516) will compress the spring (604), causing it to urge the bracket (516) upwardly again. If the spring (604) is also connected to the bracket (516) and flange (602), upward movement of the bracket (516) will place the spring (604) in tension, urging the bracket downwardly again.

The spring also facilitates convenient installation by maintaining the upper (510) and lower (506) shaft members in the neutral position relative to one another, meaning they do not need to be manually held in place or otherwise be temporarily fixed during installation.

It will be understood that the vertical biasing means (604) may be provided by a range of other configurations. For instance, it may be disposed within the interior passageway (506*a*) of the lower shaft member (506). It may also be provided by alternative materials, such as a resilient rubber material. There may also be more than one vertical biasing means.

Figure 7A:
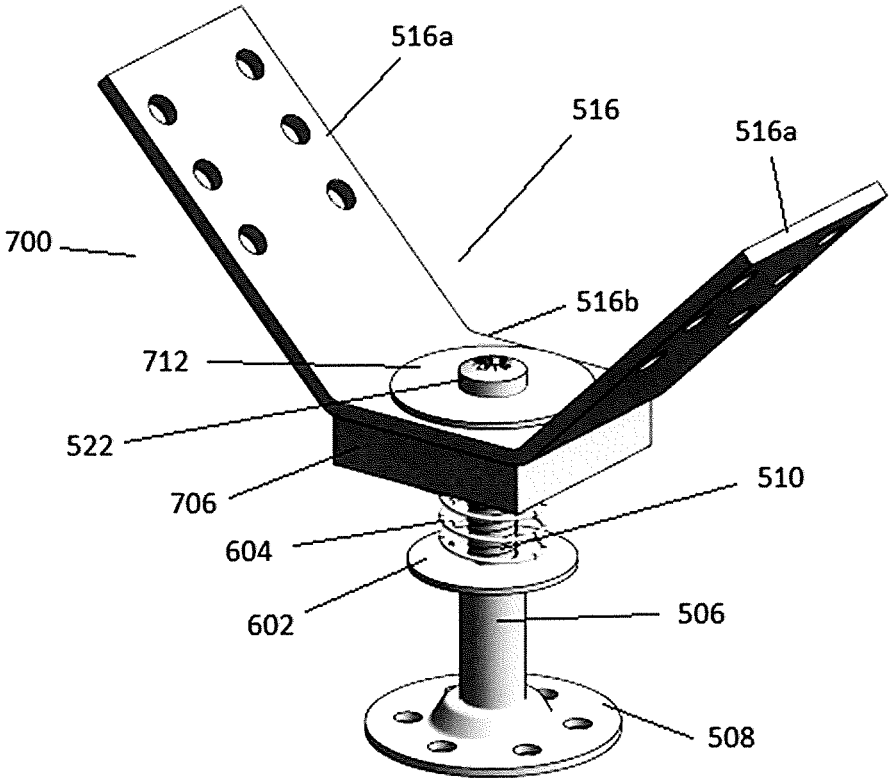
Figure 7B:
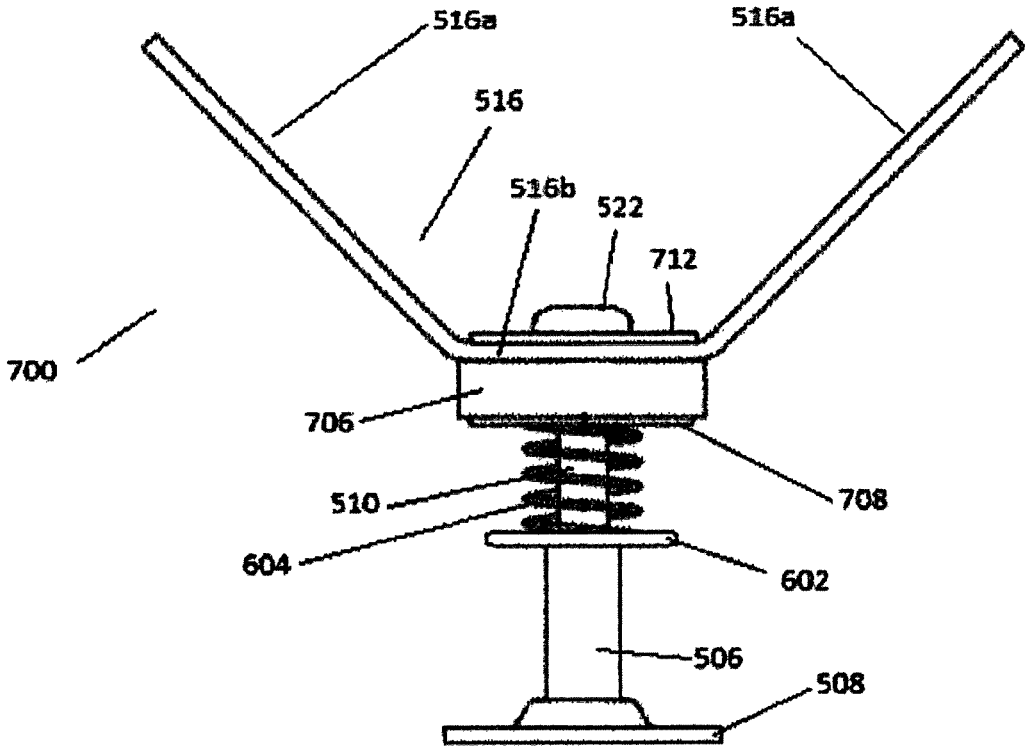
Figure 7C:
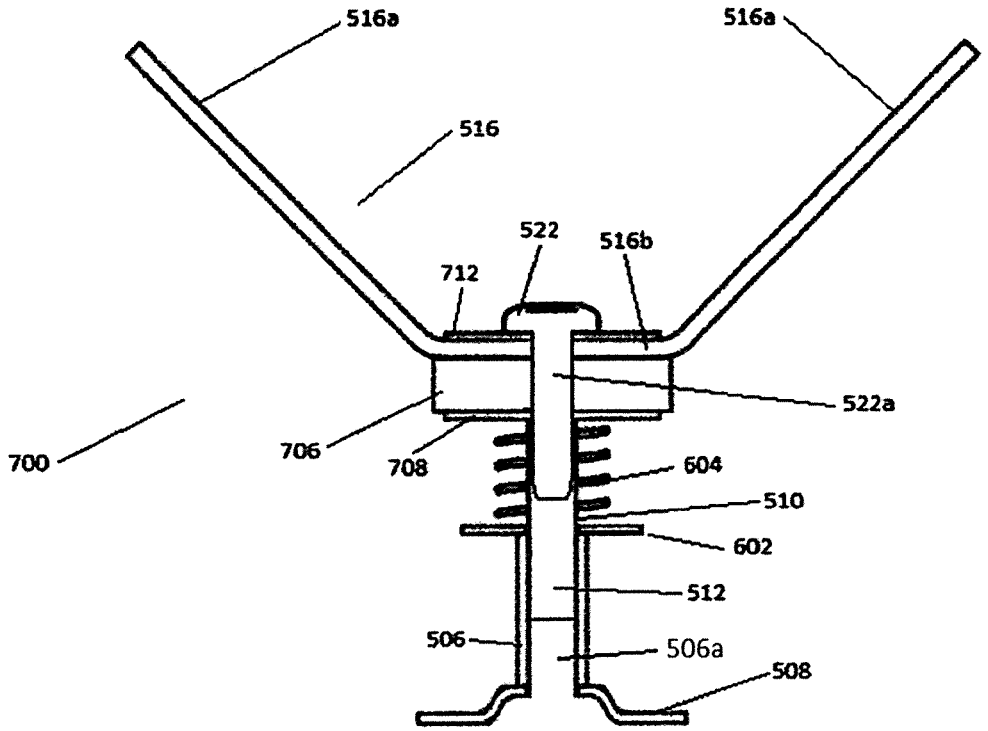

FIGS. 7A-7D show a substantially vertically movable bracket assembly (generally indicated by 700) according to another preferred exemplary embodiment of the present invention (wherein FIGS. 7A-7C are schematics for illustrative purposes only). The bracket assembly (700) of FIGS. 7A-7D is in many respects similar to those of FIGS. 5A-5C and 6, but with additional components.

As shown schematically in perspective view in FIG. 7A and in side view in FIG. 7B, the bracket assembly (700) of this embodiment includes a horizontal biasing means (706) configured to oppose applied horizontal (lateral) forces acting on the bracket assembly and thus further promote its lateral stability. The horizontal biasing means (706) is clamped between the central portion (516*b*) of the bracket (516) and a flange (708), in this embodiment provided by a circular disc, provided at the distal (upper) end of the upper shaft member (510). In this embodiment, the horizontal biasing means (706) is provided by a bearing formed from resilient rubber material, although a range of suitable alternative configurations are possible, both in terms of the material from which the horizontal biasing means (706) is formed and its location and attachment within the bracket assembly (700).

There is also another flange (712), likewise provided by a circular disc, clamped between the central portion (516*b*) of the bracket (516) and the head of the fastener (522). The flange (712) helps stabilise the bracket (516) in use as well as promoting robustness of the connection between the bracket (516) and upper shaft member (510). These components (the flanges (708, 712) and horizontal biasing means (706)) can collectively be thought of as "stabilising members".

Figure 7D:
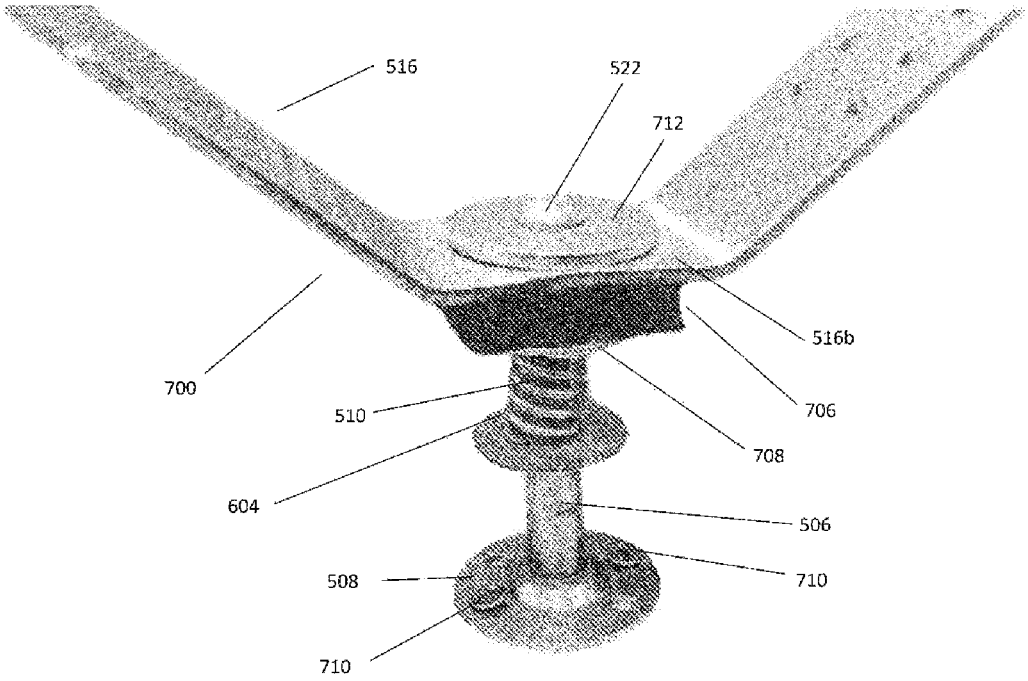

As best shown in FIG. 7D, the bracket assembly (700) of this embodiment was developed by modifying the components of the bracket assembly of NZ631234 (and the corresponding TRACKLOK® product).

In particular, the lower shaft member (506) is provided by the existing elongate member of the TRACKLOK® product, and is connected to the partition wall using the plinth/base plate (508) of the TRACKLOK® product (with FIG. 7D also showing the fastening means (screws (710)) for attaching the plinth/base plate (508) to the partition wall). The bracket (516) and fastener (522) are likewise those of the TRACKLOK® product; as are the rubber bearing (706) and flanges (708) and (712).

The modification resides in the insertion of the upper shaft member (510) into the lower shaft member (506), such that the lower shaft member (506) acts as a sleeve within which the upper shaft member (510) slides vertically (note, while a thread is visible on the upper shaft member (510), this has no functional significance).

The bracket (516) is then affixed to the upper shaft member (510) using the fastener (522), such that the bracket (516) is connected to and slides vertically together with the upper shaft member (510). Equally, the ancillary components of this embodiment (rubber bearing (706); flanges (708), (712)) are mounted in a fixed relationship with the upper shaft member (510) and the bracket (516). The spring (604) is coiled about the upper shaft member (510), and functions as described above with reference to FIG. 6.

FIG. 7C is a cross-sectional view of the bracket assembly (700) of this embodiment, and usefully shows the connection/relationship between the respective components. As already described above with reference to FIGS. 5A-5C, the lower shaft member (506) is configured with an interior passageway (506*a*) that acts as a sleeve within which the upper shaft member (510) slides vertically in use. Accordingly, a portion (512) of the upper shaft member (510) is disposed in the interior passageway (506*a*). The length of the portion (512) disposed within the interior passageway (506*a*) will vary as the upper shaft member (510) slides up and down in response to forces imposed on the bracket (516). Importantly, it can be seen that the interior passageway (506*a*) is dimensioned so as to provide a snug fit about the upper shaft member ((510), specifically portion (512)), while still allowing slidability between the respective shaft members. In this way, robustness of the system is promoted.

It can also be seen that the elongate shank (522*a*) of the screw (522) passes through the bracket (516) and into the upper shaft member (510), thereby fixedly connecting the bracket (516) to the upper shaft member (510) such that, in use, they move vertically together. The elongate shank (522*a*) of the screw (522) also passes through the flanges (712, 708) and the bearing member (706), with the effect that the flanges (712, 708) and bearing member (706) are likewise fixedly connected to both the bracket (516) and the upper shaft member (510) and accordingly move vertically up and down therewith in use.

It will be understood that the components of the bracket assembly of FIGS. 5A-5C, 6, and 7A-7D are formed from suitable materials. It is particularly preferred for at least the shaft members and/or the bracket to be formed from stainless steel. However, the skilled person may envisage other appropriate materials for the shaft members, the bracket, and/ or the other components of the bracket assembly. In the prototype of FIG. 7D the bracket was made of galvanised steel (taken from an early Tracklok® bracket), the upper shaft member of stainless steel and the lower shaft member and plinth/base plate made of brass.

It will be appreciated that the bracket assembly of the present invention is advantageous in a number of respects. It provides a means of connection between the partition wall and the roof structure that allows for a measure of vertical deflection, while also having effective resistance to lateral loading. In many embodiments, the respective components of the bracket assembly are also retained in relation to one another by a biasing means and/or a stop. In addition to enhancing the effectiveness of the bracket assembly in use, these features also mean the bracket assembly is much easier to install as its components are maintained in the neutral position, avoiding the need for the components to be manually held in place (or otherwise temporarily fixed, such as by a cable tie). In preferred embodiments, installation is further facilitated by the bracket being able to rotate relative to the shaft, allowing the bracket to be easily positioned or repositioned as required.

It will of course be realized that while the foregoing has been given by way of illustrative example of this invention, all such and other modifications and variations thereto as would be apparent to persons skilled in the art are deemed to fall within the broad scope and ambit of this invention as is hereinbefore described.

It will also be understood that the present invention relates to an assembled bracket assembly (both in its own right, and when installed), as well as the respective parts of the bracket assembly, and/or a kit of such parts.

If any reference numeral(s) is/are used in a claim or claims then such reference numeral(s) should not be considered as limiting the scope of that respective claim or claims(s) to any particular embodiment of the drawings.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. it will be taken to mean an inclusion of not only the listed components it directly references, but also other non-specified components or elements. This rationale will also be used when the term 'comprised' or 'comprising' is used in relation to one or more steps in a method or process.

The invention claimed is:

1. A bracket assembly for attachment to a partition wall, comprising:

a first attachment system for attaching the bracket to an upper surface of a partition wall;

a second attachment system for attaching the bracket to an upper structure;

a shaft; and a sleeve comprising a hollow region for slidably receiving a portion of the shaft therein;

wherein the second attachment system is connectable to the sleeve and the first attachment system is connectable to the shaft, wherein the shaft is longer than the sleeve and the shaft has a stop at each end and wherein in use the sleeve is slidable on the shaft between the stops to accommodate vertical displacements between the wall and the upper structure.

2. A bracket assembly as claimed in claim 1, wherein the bracket assembly is configured with a neutral position, being the position, in use, of the components of the bracket assembly relative to one another in the absence of applied forces acting on the bracket assembly so that the sleeve in the neutral position is located between an upper shaft portion and a lower shaft portion.

3. A bracket assembly as claimed in claim 2, wherein the bracket assembly comprises at least one vertical biasing member configured and dimensioned to, in use, retain the components of the bracket assembly in the neutral position in the absence of applied vertical forces and to oppose applied vertical forces acting on the bracket assembly in at least one direction.

4. A bracket assembly as claimed in claim 3, wherein the at least one vertical biasing member is disposed about the lower shaft portion.

5. A bracket assembly as claimed in claim 3, wherein the at least one vertical biasing member is disposed about the upper shaft portion.

6. A bracket assembly as claimed in claim 3, wherein the at least one vertical biasing member comprises a pair of biasing members with one disposed about the lower shaft portion and the other disposed about the upper shaft portion.

7. A bracket assembly as claimed in claim 6, wherein each of the pair of biasing members is a spring.

8. A bracket assembly as claimed in claim 7, wherein the bracket assembly is configured to accommodate vertical movement of between substantially 20 mm to 30 mm in either direction from the neutral position.

9. A bracket assembly as claimed in claim 8, wherein the bracket assembly is configured to accommodate vertical movement of about 25 mm in either direction from the neutral position.

10. A bracket assembly as claimed in claim 7, wherein the bracket assembly comprises at least one horizontal biasing member configured and dimensioned to, in use, oppose applied forces acting on the bracket assembly in at least one substantially horizontal direction.

11. A bracket assembly as claimed in claim 9, wherein the bracket has a profile formed substantially as a truncated V-shape, comprising an apertured central portion and a pair of angled wing portions.

12. A bracket assembly as claimed in claim 11, wherein the wing portions are configured to, in use, be connected to the overhead structure via linking components.

13. A bracket assembly as claimed in claim 12, wherein the sleeve comprises a pair of stabilising members at least one of the pair having a central passageway therethrough complementary to the shaft, and each is configured to, in use, be disposed one on either side of the apertured central portion of the bracket and connected to one another to attach the sleeve to the apertured central portion of the bracket to assist in preventing the bracket from tilting.

* * * * *